United States Patent [19]

Sunagawa et al.

[11] Patent Number: 4,955,105

[45] Date of Patent: Sep. 11, 1990

[54] VACUUM CLEANER

[75] Inventors: Masao Sunagawa; Fumio Jyoraku; Yoshitaro Ishii, all of Hitachi; Susumu Satoo, Takahagi, all of Japan

[73] Assignee: Hitachi, Ltd., Tokyo, Japan

[21] Appl. No.: 163,377

[22] Filed: Mar. 2, 1988

[30] Foreign Application Priority Data

| | | | |
|---|---|---|---|
| Mar. 6, 1987 | [JP] | Japan | 62-50066 |
| Mar. 6, 1987 | [JP] | Japan | 62-50072 |
| Mar. 20, 1987 | [JP] | Japan | 62-63880 |
| Mar. 20, 1987 | [JP] | Japan | 62-63883 |

[51] Int. Cl.[5] ..... A47L 9/00

[52] U.S. Cl. ..... 15/323; 15/327.5

[58] Field of Search ..... 15/323

[56] References Cited

U.S. PATENT DOCUMENTS

| | | | |
|---|---|---|---|
| 2,367,437 | 1/1945 | Salt | 15/323 |
| 2,528,249 | 10/1950 | Serwin | 15/323 X |
| 2,534,122 | 12/1950 | Hamala | 15/323 |
| 3,159,862 | 12/1964 | MacFarland | 15/323 |
| 3,254,359 | 6/1966 | Coll | 15/323 X |
| 3,328,826 | 7/1967 | Amos | 15/323 |
| 3,778,863 | 12/1973 | Westorgren et al. | 15/323 |
| 3,977,037 | 8/1976 | Miyake et al. | 15/323 X |

FOREIGN PATENT DOCUMENTS

| | | | |
|---|---|---|---|
| 550658 | 3/1923 | France | 15/323 |
| 681242 | 1/1930 | France | 15/323 |
| 704192 | 2/1931 | France | 15/323 |
| 1365162 | 5/1964 | France . | |
| 669893 | 4/1952 | United Kingdom | 15/323 |

*Primary Examiner*—Chris K. Moore

*Attorney, Agent, or Firm*—Antonelli, Terry, Stout & Kraus

[57] ABSTRACT

A vacuum cleaner comprises a vacuum cleaner body in which at least a dust collecting chamber, an electric blower chamber, and an exhaust chamber are formed integrally and an accommodating case for accommodating the vacuum cleaner body and attachments of the vacuum cleaner, and a suction opening and an exhaust opening are provided in the accommodating case which includes a body case accommodating at least the vacuum cleaner body and a cover case for covering an opening of the body case, with the result that a portable, compact vacuum cleaner is provided.

30 Claims, 9 Drawing Sheets

VACUUM CLEANER

BACKGROUND OF THE INVENTION

1. FIELD OF THE INVENTION

The present invention relates to a vacuum cleaner in which a vacuum cleaner body and a set of attachments such as a hose and suction port members are accommodated in an accommodating case and, more particularly, to a vacuum cleaner which is capable of effecting a cleaning operation even if the accommodating case is closed.

2. DESCRIPTION OF THE RELATED ART

In a conventional vacuum cleaner of the type described in, for example, Japanese Utility Model Examined Publication No. 44-25658; in which a set of attachments or components for the cleaner can be accommodated in an accommodating case, sufficient consideration has not been given to a method of assembling a vacuum cleaner body, the productivity of component parts, and the handling features of the cleaner, although consideration has been given to the accommodation of components.

A disadvantage of the prior art described above, resides in the fact that parts accommodating section is installed on the vacuum cleaner body itself resulting in the structure of the vacuum cleaner being complicated.

Specifically, since the arrangement is such that individual components that constitute an electric blower, a dust collecting section, an exhaust section, etc. are assembled directly onto the vacuum cleaner body and are secured to the same to assemble the overall unit, large vacuum cleaner bodies must be handled from an early stage of the assembly process. Furthermore, a very large number of stages are involved if the stage of installing the parts accommodating section is included. Therefore, another disadvantage resides in the fact that the handling efficiency during the production process is deteriorated, the management of supply of parts is complicated, and, since the process cannot be separated, a large assembly site is involving a long assembly line is required.

In addition, the vacuum cleaner body having the parts accommodating section has the function of a case for holding and protecting the accommodated parts. Accordingly, there have been additional disadvantages in that, since a considerable degree of strength is required, the thickness of the overall unit tends to be large, and the size of even unnecessary portions must be made large.

Moreover, a further disadvantage resides in the fact that, since the vacuum cleaner body also serves as an external cover portion for which design features must be taken into consideration, it is impossible to freely select its configuration due to restrictions in the conditions of the above-described strength and structure, so that its handling features as a vacuum cleaner must be sacrificed.

In addition, since, as described above, the component parts are assembled directly onto the vacuum cleaner body, when a model change is effected into a type having a different external configuration, including cases where accommodated parts differ or the external configuration of the vacuum cleaner differs, or when an attempt is made to provide a plurality of models, it has been necessary to exclusively design the respective types of vacuum cleaner bodies, and it is not economically advantageous to repeat on each such occasion the design of an installing section for the electric blower, i.e., an electric component, and the design of a dust collecting section and an exhaust section for which much labor is required in the examination of noise and suction performance, and, in fact, it has not been possible to do so easily.

SUMMARY OF THE INVENTION

Accordingly, an object of the present invention is to provide a vacuum cleaner which facilitates assembly operations and provision of models having different external configurations, is capable of being made into a compact size, and is convenient when carried around, thereby overcoming the above-described disadvantages encountered in the prior art.

To this end, according to the present invention, there is provided a vacuum cleaner is provided which comprises a vacuum cleaner body in which at least a dust collecting chamber, an electric blower chamber, and an exhaust chamber are integrally formed and an accommodating case for accommodating the vacuum cleaner body and attachments of the vacuum cleaner, is provided with at least a suction opening communicating with the dust collecting chamber and an exhaust opening communicating with the exhaust chamber being formed in the accommodating case. The accommodating case includes a body case for accommodating at least the vacuum cleaner body and a cover case for accommodating the attachments of the vacuum cleaner and adapted to close an opening of the body case.

In accordance with the present invention, since the overall vacuum cleaner in which the dust collecting chamber, the electric blower chamber, and the exhaust chamber are formed integrally formed as a unitary structure is accommodated in the accommodating case, and is detachably secured by screws or the like, the vacuum cleaner body itself can be completed as a unit having the function of a vacuum cleaner. In terms of the assembling operation, it suffices if a minimum number of parts related to the assembly is handled, and it is unnecessary to handle the large accommodating cases and other attachments in stages of the assembling operation to which they are not directly related.

In addition, as for the assembly of parts onto the accommodating case, it suffices if the vacuum cleaner body completed with the same level of finish as that of the attachments including the suction port member, so that the installation of parts inside the accommodating case, which is the final step, can be extremely simplified.

Moreover, since the vacuum cleaner body ceases to be an external cover part for which design features must be taken into consideration, and is protected by the accommodating case, the vacuum cleaner body can be provided with a minimum required strength, and its configuration can be minimized, so that it is possible to provide a compact, lightweight vacuum cleaner.

Meanwhile, since the vacuum cleaner body can be handled as a large component part to be accommodated as a unit, and the configuration of the accommodating case can be determined separately from that of the parts to be accommodated in the light of its design as an external cover portion, the configuration of the accommodating case can be selected with a large degree of freedom which allows the handling features to be emphasized.

Furthermore, with respect to development of models having different configurations of the accommodating cases, since the vacuum cleaner body can be handled as a common unit, only the accommodating case portion needs to be designed, so that labor required in development can be reduced substantially.

DETAILED DESCRIPTION OF THE PREFERRED EMBODIMENTS

Figure 1:
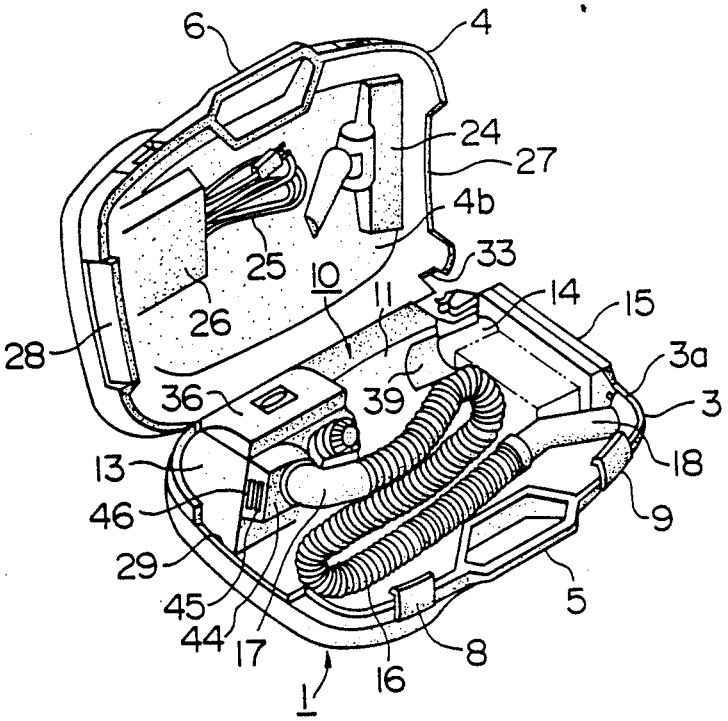
FIG. 1 is a perspective view of a first embodiment of a portable vacuum cleaner of the present invention in a state in which a cover case is opened.
Figure 2:
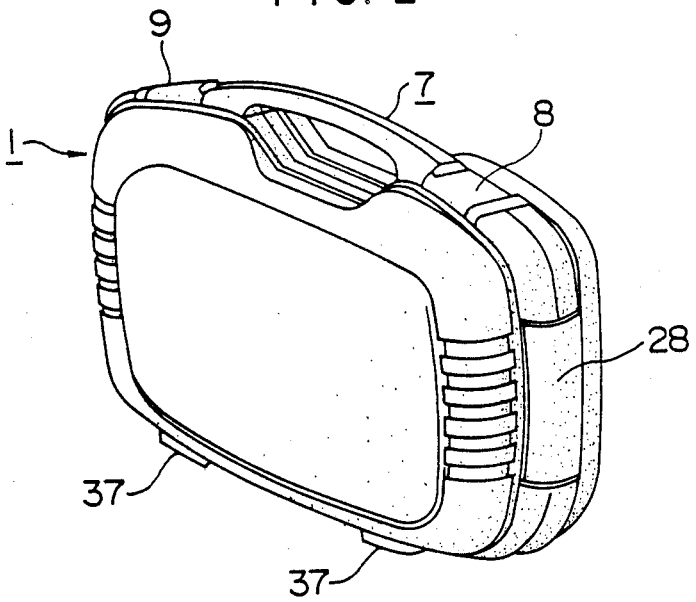
FIG. 2 is an overall perspective view of a portable vacuum cleaner of FIG. 1 in a state in which the cover case is closed.
Figure 3:
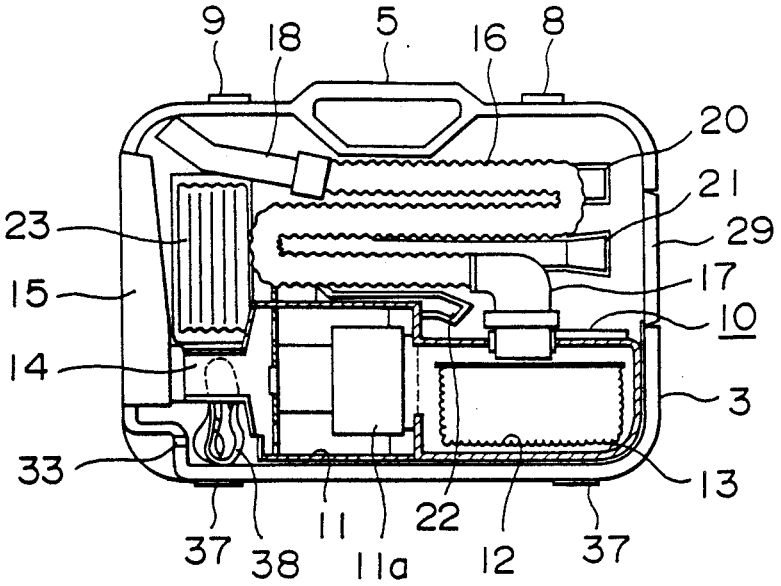
FIG. 3 is a top plan view of a body case portion of the vacuum cleaner of FIG. 1.
Figure 5:
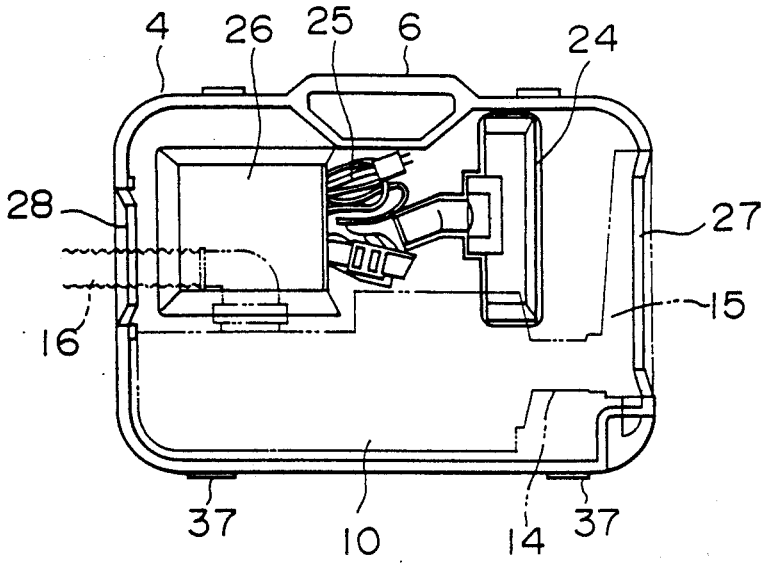
FIG. 5 is a top plan view of a cover case for the vacuum cleaner of FIG. 1.

Referring now to the drawings wherein like reference numerals are used throughout the various view to designate like parts and, more particularly, to FIG. 1, according to this figure, a portable type vacuum cleaner in accordance with the present invention comprises an accommodating case generally designated by the reference numeral 1 including a body case 3 and a cover case 4 connected to each other at one end of each of the surfaces by a hinge 2 formed integrally therewith and made of a plastic or the like. Handle portions 5, 6 are formed on the body case 3 and the cover case 4 at the other ends of the surfaces thereof which close together that oppose the hinge 2. The handle portions 5, 6 are integrated in a closed state, as shown in FIG. 2, and form an integrated handle 7. Clamps 8, 9 are provided which have a retaining function when the accommodating case 1 is closed. As shown in FIG. 3, a vacuum cleaner body 10 is formed into a unit in which an electric blower chamber 11 for accommodating an electric blower 11*a*, a dust collecting chamber 13 for incorporating a dust collecting paper bag filter 12, a small-diameter exhaust pipe 14, and a box-like exhaust chamber 15 are integrally formed of a synthetic resin. A suction hose 16 has, at one end thereof, a swivel joint 17 rotatably and detachably fixed to the dust collecting chamber 13 and, at the other end thereof, a joint 18. In this embodiment, the vacuum cleaner body 10 is detachably fixed to the body case 3 by screws or the like (not shown). A plurality of casters 19, 19*a*, formed as rotary bodies, are installed on an outer surface of the body case 3. The casters 19, 19*a* allow the accommodating case 1 to travel on the floor, and ball-shaped casters, which do not cause any hindrance when the accommodating case 1 is carried, are preferable. The inner surface of the accommodating case 1, on the side of the body case 3, is provided with a plurality of protrusions 50, 50*a*, and 50*b* which serve as holding portions for the attachments of the vacuum cleaner body and allow the vacuum cleaner 10 and the attachments of the vacuum cleaner to be secured in place or detachably accommodated. Extension 20, 21 pipes are disposed in the body case 3 and a suction 22 member is provided for use in tight spaces. A plurality of replacement paper bag filters 23 are grouped together and accommodated in a space surrounded by an inner wall surface of the vacuum cleaner body 10, the exhaust pipe 14, and the exhaust chamber 15. A recess 24*a* forming a holding portion for a suction member 24 for the floor use and a pocket 26 forming a holding portion for a power cord 25 and other small articles are provided on the inner surface of the vacuum cleaner body 10 on the side of the cover case 4 at a portion where a portion against which the vacuum cleaner body 10 abuts, as indicated by the dash-dot line in FIG. 5.

Figure 8:
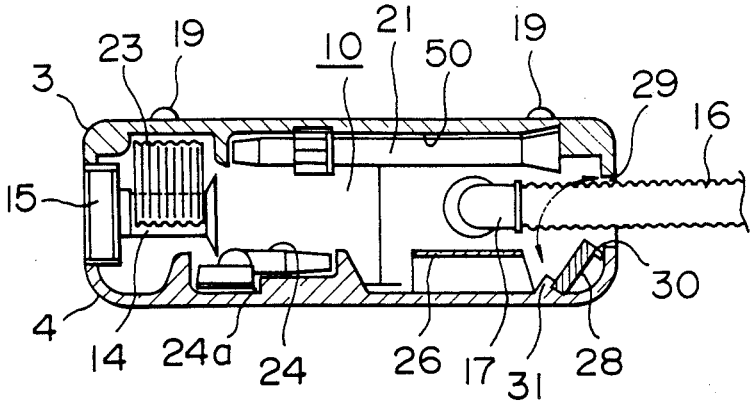
FIG. 8 is a horizontal cross-section view of portion of the vacuum cleaner of FIG. 1.

A notch 27 for clamping a portion of the exhaust chamber 15 of the vacuum cleaner body 10 and a notch 29 serving as an opening for suction are provided between the plane of an opening 3*a* of the body case 3 and the plane of an opening 4*a* of the cover case 4. An openable cover 28 is provided at the notch 29, with the cover 28, supported by a hinge 30 provided on the cover case 4, opening and closing as indicated by the arrow in FIG. 8, and engaging with an engaging projection 31 provided inside the cover case 4 to maintain an open state. The notch 27 forms an opening for exhaust and a plurality of slits 15*a* communicating with the atmosphere are formed in the exhaust chamber 15 which fits with the notch 27.

Figure 9:
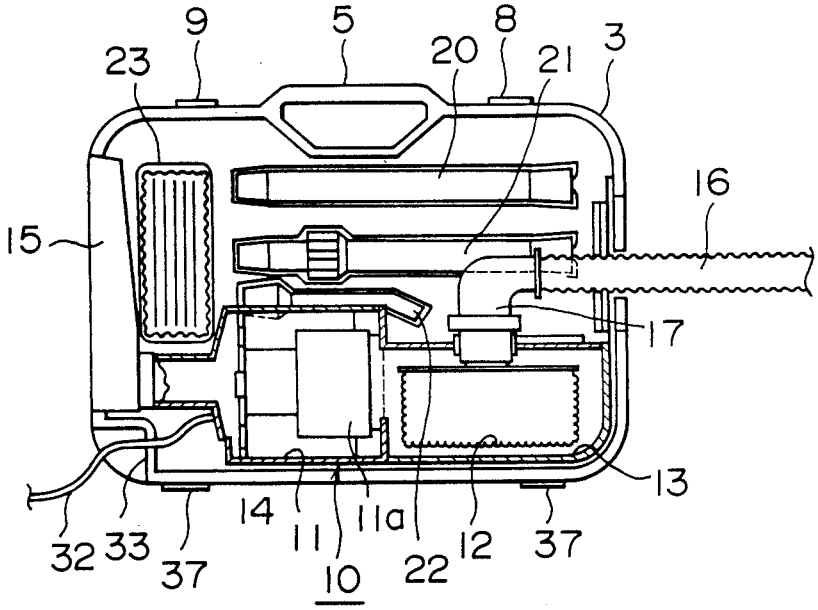
FIG. 9 is a top plan view of the body case portion of the vacuum cleaner of FIG. 1 in a state in which a suction hose is drawn out.

FIG. 9 illustrates a state in which the swivel joint 17 is rotated and the hose 16 is caused to project to outside the accommodating case 1.

Figure 6:
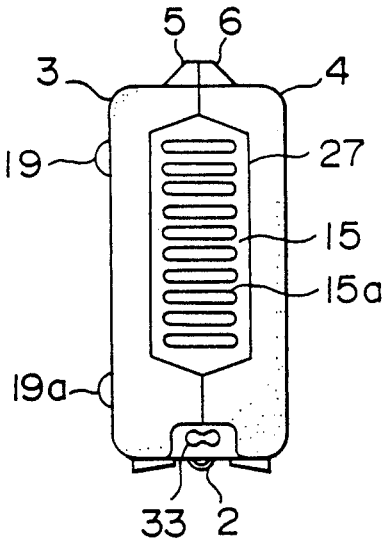
FIG. 6 is a left-hand side elevational view of the vacuum cleaner of FIG. 1.
Figure 7:
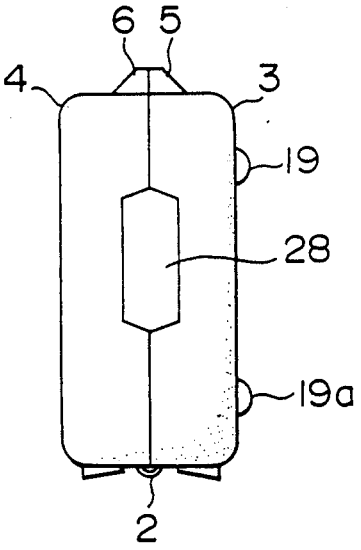
FIG. 7 is a right-hand side elevational view of the vacuum cleaner of FIG. 1.

The accommodating case 1 is provided with a gourd-shaped recess 33, as shown in FIG. 6. When the power cord 32 is fitted with this recess 33 so as to be provisionally fixed, the power cord 32 does not become damaged by being clamped by the peripheral contact surfaces of the body case 3 and the cover case 4 when the accommodating case 1 is opened and closed.

Figure 10:
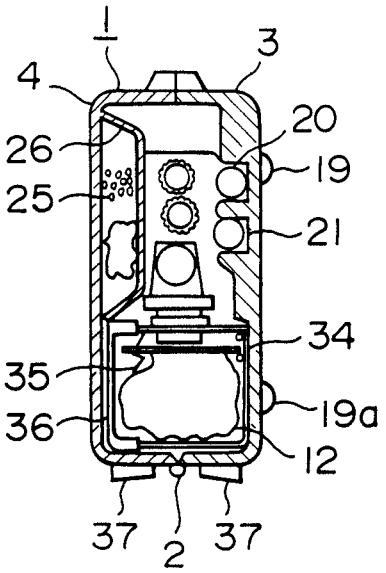
FIG. 10 and 11 are vertical cross-section views of portions of the vacuum cleaner of FIG. 1.

As shown in FIG. 10 the pocket 26 and the dust collecting chamber 13, and the paper bag filter 12 is supported by a projection 34 provided on the vacuum cleaner body 10 and a retaining spring 35. A dust collection cover 36 covers an opening provided in the dust collecting chamber 13. The arrangement is such that the plane of an opening 13*a* in the dust collecting chamber 13 is made substantially parallel with the plane of an opening 3*a* of the body case 3. The dust collection cover 36 is provided detachably at the opening 13*a*. Legs 37 are provided on the lower surface of the accommodating case 1 on the side of the hinge 2.

Figure 11:
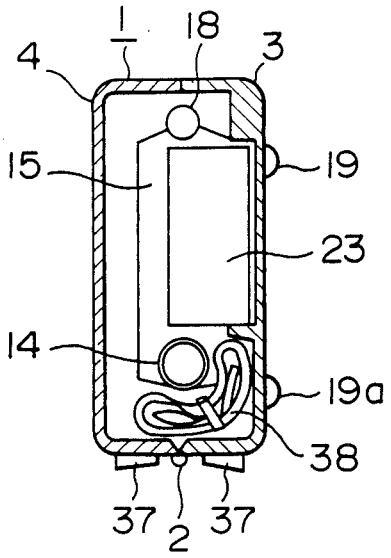

As shown in FIG. 11, a flexible shoulder band 38 is accommodated in a bent form in a space between the body case 3 and the exhaust pipe 14.

Figure 12:
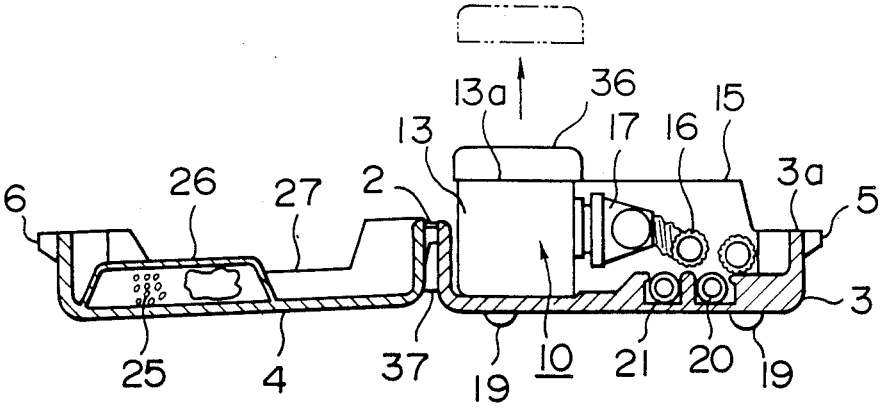
FIG. 12 is a vertical cross-section view of portions of the vacuum cleaner of FIG. 1 in a state in which the cover case is opened.
Figure 13:
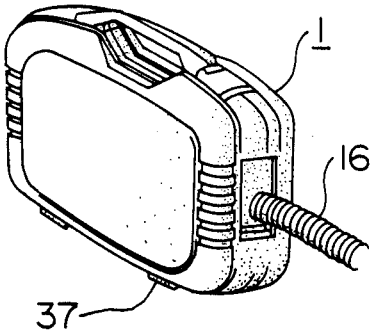
FIG. 13 is a perspective view of the vacuum cleaner of FIG. 1 in a state in which the vacuum cleaner is placed upright on a floor during use.
Figure 14:
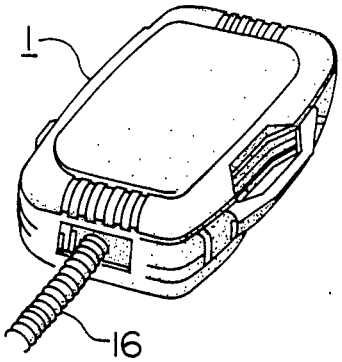
FIG. 14 is a perspective view of the vacuum cleaner of FIG. 1 in a state in which the vacuum cleaner is allowed to move on the floor during use.
Figure 15:
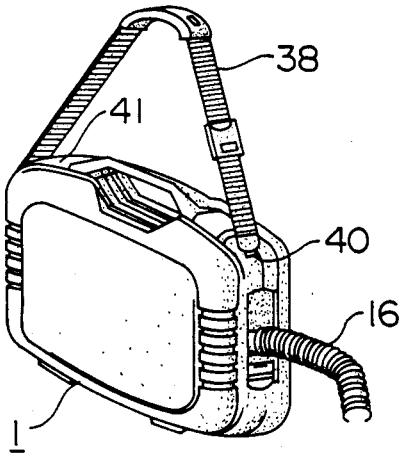
FIG. 15 is a perspective view of the vacuum cleaner of FIG. 1 in a state in which the vacuum cleaner is suspended from the user's shoulder during use.
Figure 16:
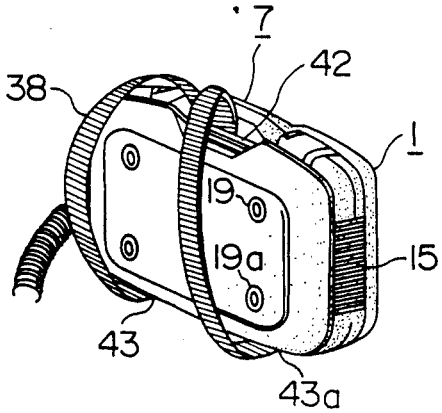
FIG. 16 is a perspective view of the vacuum cleaner of FIG. 1 in a state in which the vacuum cleaner is strapped to the user's back during use.
Figure 17:
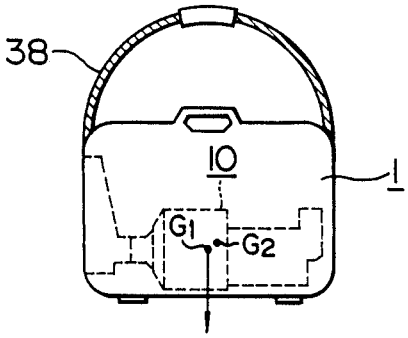
FIG. 17 is a plan view of the vacuum cleaner of FIG. 1 illustrating the position of the center of gravity of a vacuum cleaner body.
Figure 18:
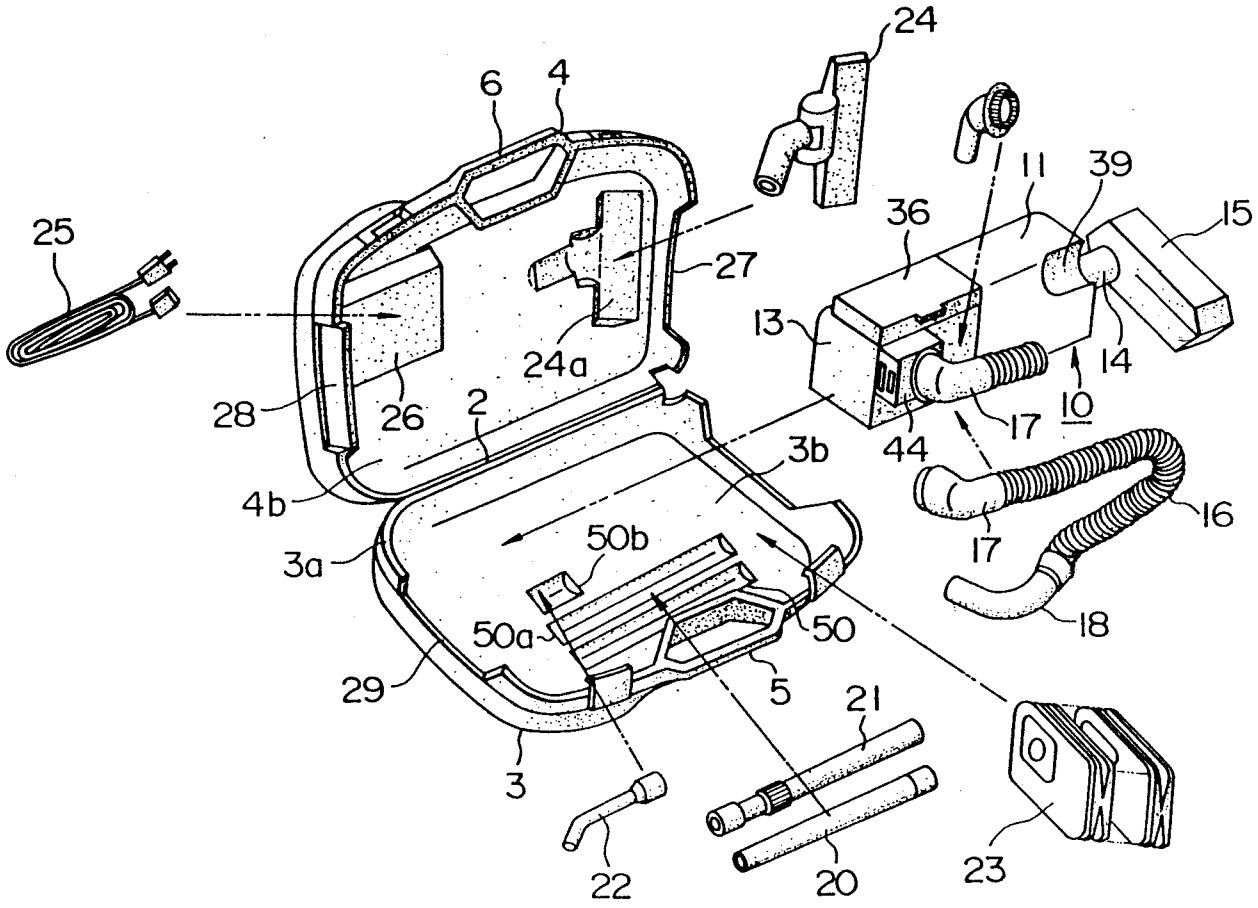
FIG. 18 is an overall exploded perspective view of the vacuum cleaner in FIG. 1.

FIG. 12 illustrates a state in which the accommodating case 1 is opened. The accommodating case 1 can be opened about 180° by making use of the hinge 2 and the legs 37. In open state, it is possible to identify at first sight the positions in which the attachments of the vacuum cleaner are accommodated therein. In addition, since the accommodating case 1 is placed stably on a flat surface, such as a floor surface, the operation of removing the attachments from the accommodating case 1 and storing the same therein can be facilitated.

The suction hose 16 and the swivel joint 17 are arranged in the vicinity of the junction between the body case 3 and the cover case 4 which have substantially the same depths, i.e., in the vicinity of the center of the accommodating case 1. However, since the suction hose 16 and the swivel joint 17 are deformable so as to be disposable along a side of the body case 3, if they are accommodated along the configuration of the inner wall of the body case 3 during storage, it is possible to store them with their shape stably maintained even if the suction hose 16 has a tendency to expand. Thus, when the cover case 4 is closed, the suction hose 16 does not cause any hindrance so as to be caught between parts.

Figure 4:
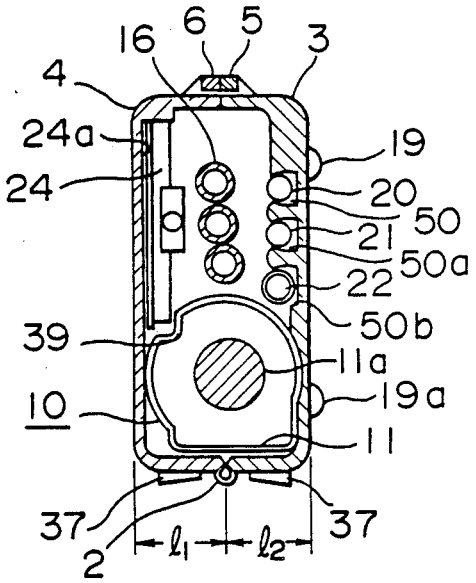
FIG. 4 is a vertical cross-section view of portions of the vacuum cleaner of FIG. 1.

Since a large and heavy component, such as the suction member 24 for the floor use, is easily dislocated when an impact is applied thereto, that component can be held securely if an arrangement is provided as shown in FIG. 4 such that it is clamped with a recess 39 provided on the vacuum cleaner body 10.

As shown in FIG. 4, the suction member 22 for use in tight spaces is adapted to engage with an accommodating recess 50*b* having a substantially semicircular cross section and formed on the inner side of the body case 3 between the vacuum cleaner body 10 incorporating the electric blower 11 and the accommodating case 4 to make effective use of the spatial volume of the accommodating case 1. For this reason, and because it can be pressed from above by the vacuum cleaner body 10, the suction port 22 can be securely held. This arrangement is particularly effective when a part which is heavy, though small, is accommodated and held.

Engaging portions 40, 41, 42, 43, 43*a* for installing the shoulder band 38 are formed in the accommodating case 1. The engaging portions 40, 41 are provided in the vicinity of opposite ends of an outer upper surface 1*a* of the accommodating case 1, while the engaging portion 42 is provided in a central portion of the outer upper surface 1*a* of the accommodating case 1. The engaging portions 43, 43*a* are provided in the vicinity of the opposite ends of an outer lower surface 1*b* of the accommodating case 1.

As shown in FIG. 1, a switch case 44 is formed integrally with the dust collecting chamber 13. The switch case 44 incorporates a power switch 45 and an indicator 46 which indicates a state of loading of the paper bag filter 12 in response to the negative pressure in the dust collecting chamber 13.

When the cover 28 is opened, the power switch 45 can be accessed through the notch 29 serving as an opening for suction, and the indicator 46 can be visually observed.

In terms of the modes of the cleaning operation, those shown in FIGS. 13 to 16 can be adopted. Namely, in the first mode shown in FIG. 13, the accommodating case 1 is placed upright on the floor surface by making use of the legs 37. In the second mode shown in FIG. 14, the accommodating case 1 is allowed to move on the floor surface by using the casters 19, 19*a*. In the third mode shown in FIG. 15, the accommodating case 1 is suspended from the user's shoulder by fixing the opposite ends of the shoulder band 38 to the engaging portions 40, 41 on the outer upper surface 1*a* of the accommodating case 1. In the fourth mode, the accommodating case 1 is strapped to the user's back by fixing the central portion of the shoulder band 38 to the engaging portion 42 provided in the center of the outer upper surface 1*a* of the accommodating case 1 and the opposite ends of the shoulder band 38 to the engaging portions 43, 43*a* on the outer lower surface 1*b* of the accommodating case.

Since the vacuum cleaner body 10 is disposed such as to oppose an inside surface 4*b* of the cover case 4 at a close distance therefrom or abuts against the same, the vacuum cleaner body 10 is clamped between the inside surface 4*b* of the cover case 4 and in inside surface 3*b* of the body case 3. The thickness $l_1$ of the body case 1 and that $l_2$ of the cover case 4 are set to be substantially identical with each other.

The suction hose 16 is installed in the dust collecting chamber 13 between the suction port member 24 and the pocket 26 provided on the inside surface 3*b* of the body case 3 on the one hand, and the extension pipes 20, 21 provided on the inside surface 4*b* of the cover case 4 on the other, such as to be rotatable. The total thickness of attachments of the vacuum cleaner such as the extension pipes 20, 21 provided on the inside surface 3*b* of the body case 3 and the attachments of the vacuum cleaner such as the suction port member 24 provided on the inside surface 4*b* of the cover case 4 is set to be substantially identical with or smaller than the thickness of the vacuum cleaner body 10. As shown in FIG. 10, the attachments of the vacuum cleaner are arranged parallel with the vacuum cleaner body 10 and in the state of three layers.

The vacuum cleaner body 10 is disposed in the vicinity of the hinge 2 of the accommodating case 1 and is arranged such that, when used in the first, third, and fourth modes described above, the center of gravity $G_1$ of the accommodating case 1 as a whole is located at a lower portion of the accommodating case 1. The center of gravity $G_1$ of the vacuum cleaner body 10 with respect to the horizontal direction and the center of gravity $G_2$ of the accommodating case 1 with respect to the horizontal direction are set to substantially coincide with each other.

The external dimensions of the exhaust pipe 14 are set so as to be smaller than one half that of the electric blower chamber 11. As shown in FIG. 12, at least the dust collecting chamber 13 of the vacuum cleaner body 10 projects upwardly from the plane of the opening 3*a* of the body case 3, and the dust collection cover 36 is located at its projecting portion.

Figure 19:
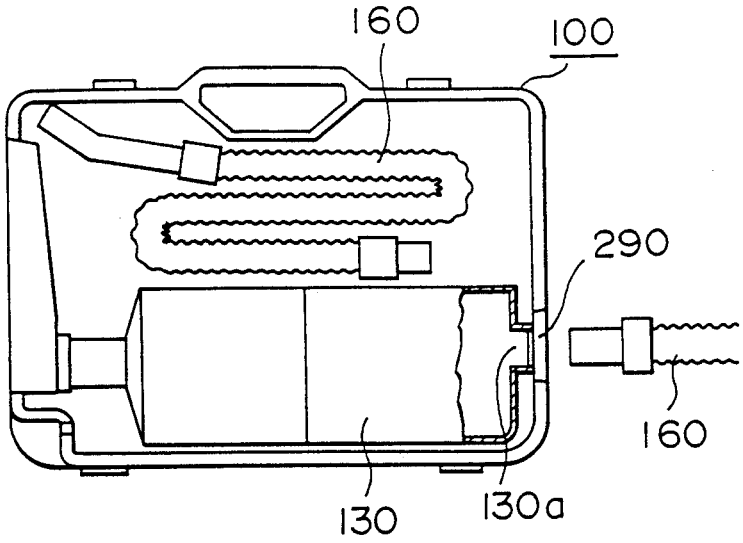
FIG. 19 is a schematic diagram illustrating the vacuum cleaner in accordance with a second embodiment of the present invention.

In the above-described embodiment, an example is shown in which the suction hose 16 can be drawn out to outside the accommodating case 1 without the suction hose 16 being detached from the dust collecting chamber 13. However, as shown in the second embodiment of FIG. 19 an arrangement may be provided such that a suction opening 290 is provided in an accommodating case 100 so as to oppose a suction opening 130*a* of a dust collecting chamber 130, and a suction hose 160 is detached from a dust collecting chamber 13 or attached thereto through the opening 290.

Figure 20:
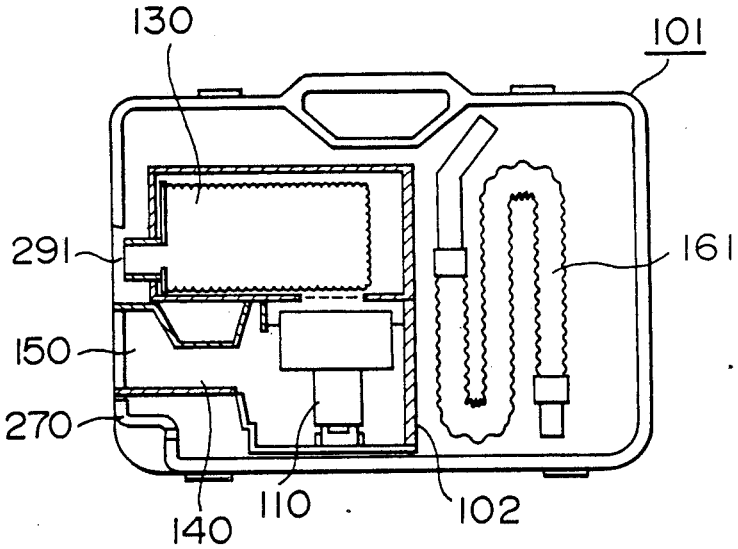
FIG. 20 is a schematic diagram of portions of the vacuum cleaner in accordance with a third embodiment of the present invention.

Furthermore, as illustrated in a third embodiment of FIG. 20, an arrangement may be provided such that a suction opening 291 and an exhaust opening 270 are arranged in the same plane in an accommodating case 101. In this case, a vacuum cleaner body 102 is arranged such that the dust collecting chamber 130 is disposed above an electric blower chamber 110, and an exhaust pipe 140 and an exhaust chamber 150 are disposed on the side of the electric blower chamber 110. The attachments of the vacuum cleaner such as a suction hose 161 are disposed on the side of the vacuum cleaner body 102.

Figure 21:
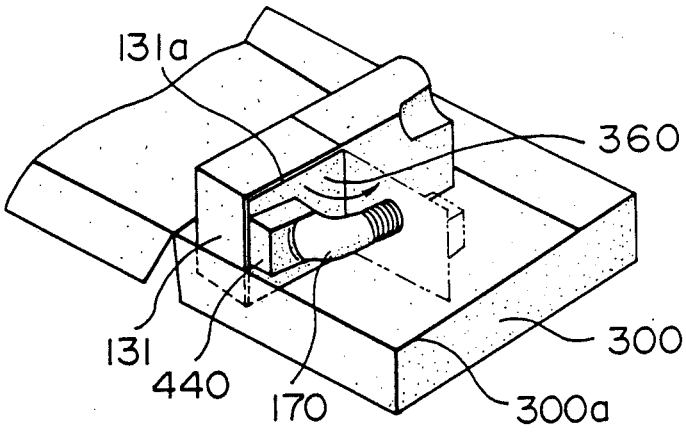
FIG. 21 is a perspective view schematically illustrating portions of the vacuum cleaner in accordance with a fourth embodiment of the present invention.

A fourth embodiment shown in FIG. 21 illustrates an example in which the plane of an opening 131*a* in the dust collecting chamber 131 is set so as to be orthogonal to the plane of an opening 300*a* in a body case 300. In this case, a swivel joint 170 for the suction hose and a switch case 440 are provided in the dust collecting chamber 360. The dust collecting chamber 360 is arranged to be openable as indicated by the two-dot chain line in FIG. 21.

Figure 22:
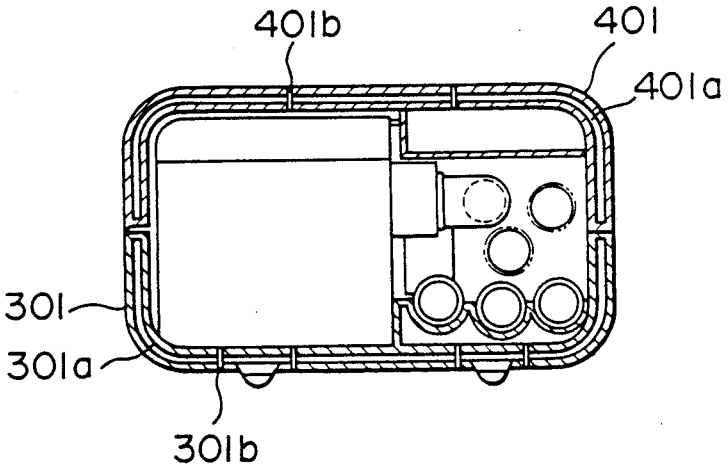
FIG. 22 is a cross-sectional view of portions of the vacuum cleaner in accordance with a fifth embodiment of the present invention.

A fifth embodiment shown in FIG. 22 illustrates a case in which a body case 301 and a cover case 401 are formed into a double-wall structure by blow moulding. Both the body case 301 and the cover case 401 are formed of a synthetic resin such as polypropylene and are arranged to be openable by a plastic hinge. Air layers 301*a*, 401*a* are formed inside the cover case 301 and the cover case 401 and communicate with the atmosphere through air holes 301*b*, 401*b* provided in the body case 301 and the cover case 401, respectively.

In accordance with the embodiments of the present invention described above, production control can be effected separately to assemble the vacuum cleaner body 10 and fabricate the accommodating case 1 and various attachments of the vacuum cleaner, and the vacuum cleaner body 10 and the attachments of the vacuum cleaner can be accommodated in the accommodating case 1 in the final stage of process. Accordingly, substantial rationalization can be attained in terms of the production control and economic efficiency through such as production of the respective parts in production sections that are most suitable and through a reduction in the number of articles to be handled in the final stage of production.

Furthermore, since the quality of the vacuum cleaner body 10 and the attachments of the vacuum cleaner can be confirmed before they are assembled onto the accommodating case, there are great advantages in terms of quality control including performance tests.

In addition, since the vacuum cleaner body 10 is protected by the accommodating case 1, the vacuum cleaner body 10 can be made thin and lightweight, and since it is not a cover portion in which design features must be taken into consideration, it is possible to eliminate unnecessary portions of the space and make effective use of the space.

Moreover, since the vacuum cleaner body 10 is made into a unit as an assembly, as for the configuration of the accommodating case, it is possible to determine the design of its external configuration without detailed portions thereof being restricted due to installation of the vacuum cleaner body 10 therein, so that its configuration can be selected with a large degree of freedom. Also, as for development of other types of model in which the accommodating case 1 is provided with different configurations, it suffices if the vacuum cleaner body 10 is accommodated as a common unit, so that only the accommodating unit 1 need to be designed. Hence, labor required in development can be alleviated substantially.

What is claimed is:

1. A vacuum cleaner comprising a vacuum cleaner body and an accommodating case for accommodating said vacuum cleaner body and attachments of the vacuum cleaner, said vacuum cleaner body comprising at least a dust collecting chamber, an electric blower chamber, and an exhaust chamber, said dust collecting chamber, said electric blower chamber and said exhaust chamber forming a unitary structure arranged in said accommodating case such that an outer profile of the exhaust chamber is in a confronting relationship with an exhaust opening of the accommodating case, wherein at least a suction opening communicating with said dust collecting chamber and the exhaust opening communicating with said exhaust chamber are formed in said accommodating case, and wherein said accommodating case includes a body case for accommodating at least said vacuum cleaner body and a cover case for accommodating said attachments of the vacuum cleaner, said cover case being adapted to close an opening of said body case forming the opening of said accommodating case.

2. A vacuum cleaner according to claim 1, wherein said vacuum cleaner body is secured to an inside surface of said body case and opposes an inside surface of said cover case at a close distance therefrom.

3. A vacuum cleaner comprising a vacuum cleaner body and an accommodating case for accommodating said vacuum cleaner body and attachments of the vacuum cleaner, said vacuum cleaner body comprising at least a dust collecting chamber, an electric blower chamber, and an exhaust chamber, said dust collecting chamber, said electric blower chamber and said exhaust chamber forming a unitary structure, at least a suction opening communicating with said dust collecting chamber and an exhaust opening communicating with said exhaust chamber are formed in said accommodating case, said accommodating case includes a body case for accommodating at least said vacuum cleaner and a cover case for accommodating said attachments of the vacuum cleaner, said cover case being adapted to close an opening of said body case, and wherein said vacuum cleaner body is clamped between an inside surface of said body case an inside surface of said cover case.

4. A vacuum cleaner according to claim 1, wherein a width of said body case is substantially identical with a width of said cover case.

5. A vacuum cleaner according to claim 1, wherein said vacuum cleaner body is detachably disposed on an inside surface of said body case.

6. A vacuum cleaner comprising a vacuum cleaner body and an accommodating case for accommodating said vacuum cleaner body and attachments of the vacuum cleaner, said vacuum cleaner comprising at least a dust collecting chamber, an electric blower chamber, and an exhaust chamber, said dust collecting chamber, said electric blower chamber and said exhaust chamber forming a unitary structure, at least a suction opening communicating with said dust collecting chamber and an exhaust opening communicating with said exhaust chamber are formed in said accommodating case, said accommodating case includes a body case for accommodating at least said vacuum cleaner body and a cover case for accommodating said attachments of the vacuum cleaner, said cover case being adapted to close an opening of said body case, and wherein a part of said exhaust chamber of said vacuum cleaner body is fitted with said exhaust opening.

7. A vacuum cleaner comprising a vacuum cleaner body and an accommodating case for accommodating the vacuum cleaner body and attachments of the vacuum cleaner, said vacuum cleaner body comprising at least a dust collecting chamber, an electric blower chamber and an exhaust chamber, said dust collecting chamber, said electric blower chamber and said exhaust chamber forming a unitary structure, said accommodating case including a body case accommodating said vacuum cleaner body and a cover case for covering an opening of said body case, wherein a holding portion for said attachments of the vacuum cleaner is formed on an inside surface of said body case and a portion other than a portion where said vacuum cleaner body is installed, and wherein a holding portion for said attachments of said vacuum cleaner is formed on an inside surface of said cover case in a portion other than a portion opposing said dust collecting chamber, and a suction hose is installed between said holding portions for said attachments of the vacuum cleaner.

8. A vacuum cleaner according to claim 7, wherein extension pipes and a suction member for use in tight spaces are disposed in said holding portion for said attachments of the vacuum cleaner in said body case, and a suction member for floor use, a power cord, and a shoulder band are disposed in said holding portion for said attachments of the vacuum cleaner in said cover case.

9. A vacuum cleaner according to claim 7, wherein a part of said attachments of the vacuum cleaner such as a suction member for use in tight spaces is secured so as to be clamped between said vacuum cleaner body and said body case.

10. A vacuum cleaner according to claim 7, wherein a recess for attachment a suction member for floor use is formed on an outer wall of said electric blower chamber of said vacuum cleaner body.

11. A vacuum cleaner according to claim 7, wherein a suction member for floor use is installed on a side of said cover case, and elongated attachments of the vacuum cleaner including extension pipes are installed on a side of said body case.

12. A vacuum cleaner according to claim 7, wherein said suction hose is installed between said holding portion for said attachments of the vacuum cleaner in a state in which said suction holes is rotatably fixed to said dust collecting chamber.

13. A vacuum cleaner according to claim 12, wherein said suction hose is installed in such a manner so as to be drawn out from a suction opening provided in said accommodating case.

14. A vacuum cleaner according to claim 7, wherein said holding portion for said attachments of the vacuum cleaner in said cover case includes a pocket for accommodating a power cord and a shoulder band.

15. A vacuum cleaner according to claim 7, wherein a width of said attachments of the vacuum cleaner disposed in said holding portion for said attachments of the vacuum cleaner is one of substantially identical with or smaller than a width of said vacuum cleaner body, and wherein said vacuum cleaner body is arranged parallel with a longitudinal extension of said attachments of the vacuum cleaner.

16. A vacuum cleaner comprising a vacuum cleaner body and an accommodating case for accommodating the vacuum cleaner body and attachments of the vacuum cleaner, said vacuum cleaner body comprising at least a dust collecting chamber, an electric blower chamber, and an exhaust chamber, said dust collecting chamber, said electric blower chamber and said exhaust chamber forming a unitary structure, wherein a height of said attachments of the vacuum cleaner as measured in a direction perpendicular to a longitudinal direction of the vacuum cleaner is one of substantially identical with or smaller than a height of said vacuum cleaner body as measured in a direction perpendicular to a longitudinal direction of the vacuum cleaner, and a longitudinal extension of said vacuum cleaner body is arranged parallel with said attachments of the vacuum cleaner.

17. A vacuum cleaner comprising a vacuum cleaner body and an accommodating case for accommodating the vacuum cleaner body and attachments of the vacuum cleaner, said vacuum cleaner body comprising at least a dust collecting chamber, an electric blower chamber and an exhaust chamber, said dust collecting chamber, said electric blower chamber and said exhaust chamber forming a unitary structure, said accommodating case includes a body case accommodating said vacuum cleaner body and a cover case for covering an opening of said body case, hinge means for securing said cover case to said body case, and wherein said vacuum cleaner body is disposed in said body case at a portion thereof where said hinge means are provided.

18. A vacuum cleaner according to claim 17, wherein at least one of small wheels and a shoulder band are disposed on a side of said body case.

19. A vacuum cleaner according to claim 18, wherein three rotary bodies serve as said small wheels, said three rotary bodies are provided on an outside surface of said body case, and at least two engaging portions are provided for installing a shoulder band on an outer upper surface of said body case.

20. A vacuum cleaner according to claim 19, wherein said engaging portions for installing a shoulder band are provided in a central portion of an upper outer surface of said body case and at opposite ends of said outer upper surface of said body case.

21. A vacuum cleaner according to claim 17, wherein the center of gravity of said accommodating case with respect to a horizontal direction of the vacuum cleaner along an axis parallel to a hinge axis of the hinge means and the center of gravity of said vacuum cleaner with respect to a horizontal direction of the vacuum cleaner along the axis parallel to the hinge axis of the hinge means substantially coincide with each other.

22. A vacuum cleaner according to claim 17, wherein said electrical blower chamber and said exhaust chamber in said vacuum cleaner body are communicated with each other by an exhaust pipe, and wherein external dimensions of said exhaust pipe are smaller than external dimensions of said electric blower chamber.

23. A vacuum cleaner comprising a vacuum cleaner body and an accommodating case for accommodating the vacuum cleaner body and attachments for the vacuum cleaner, said vacuum cleaner body comprising at least a dust collecting chamber, an electric blower chamber and an exhaust chamber, said dust collecting chamber, said electric blower and said exhaust chamber forming a unitary structure, said accommodating case including a body case for accommodating said vacuum cleaner body and a cover case for covering an opening of said body case, hinge means for securing said cover case to said body case, said vacuum cleaner body is disposed in the body case at a portion thereof where said hinge means are provided, and said dust collecting chamber of said vacuum cleaner body projects upwardly from said opening of said body case.

24. A vacuum cleaner according to claim 23, wherein an opening is provided in said dust collecting chamber, a dust collection cover for covering said opening is provided, and a plane in which said opening in said dust collecting chamber is disposed is substantially parallel with a plane in which said opening of said body case is disposed.

25. A vacuum cleaner according to claim 23, wherein the dust collecting chamber is provided with an opening, and a plane in which the opening of said dust collecting chamber is disposed is parallel to a plane in which the opening of said body case is disposed.

26. A vacuum cleaner according to claim 17, wherein an opening is provided in said dust collecting chamber, a dust collecting cover for covering said opening is provided, and a plane in which said opening in said dust collecting chamber is disposed is substantially orthogonal to a plane in which said opening of said body case is disposed.

27. A vacuum cleaner according to claim 26, wherein a suction hose is detachably provided on one of said dust collection cover or said dust collecting chamber.

28. A vacuum cleaner according to claim 26, wherein a suction hose is rotatably provided on one of said dust collecting cover or said dust collecting chamber.

29. A vacuum cleaner according to claim 28, wherein said suction hose is provided in such a manner so as to be drawn out through a suction opening provided in said accommodating case.

30. A vacuum cleaner comprising a vacuum cleaner body and an attachment case for accommodating the vacuum cleaner body and attachments for the vacuum cleaner, said vacuum cleaner body comprising at least a dust collecting chamber, an electric blower chamber, and an exhaust chamber, said dust collecting chamber, said electric blower and said exhaust chamber forming a unitary structure, a suction opening serving as an opening for drawing out a suction hose for communicating with said dust collecting chamber and an exhaust opening communicating with said exhaust chamber are formed in said accommodating case, said accommodating case includes a body case accommodating said vacuum cleaner body and a cover case for covering an opening of said body case, hinge means are provided for connecting said cover case to said body case, and both said body case and said cover case are made of a synthetic resin and formed into a double-wall structure.

* * * * *